United States Patent [19]

Haire

[11] 4,252,268

[45] Feb. 24, 1981

[54] LID FOR OVENABLE TRAYS AND RESULTING COMBINED CONTAINER

[75] Inventor: James P. Haire, Fallston, Md.

[73] Assignee: Maryland Cup Corporation, Owings Mills, Md.

[21] Appl. No.: 69,528

[22] Filed: Aug. 24, 1979

[51] Int. Cl.[3] ..... B65D 43/00; B65D 77/00; B65D 51/16

[52] U.S. Cl. ..... 229/43; 229/DIG. 14; 220/366

[58] Field of Search ..... 229/43, DIG. 14, 3.5 MF, 229/6 A; 220/366, 367

[56] References Cited

U.S. PATENT DOCUMENTS

| | | | |
|---|---|---|---|
| 1,843,918 | 2/1932 | Cornell | 220/366 |
| 2,361,344 | 10/1944 | Yates | 229/DIG. 14 |
| 3,367,555 | 2/1968 | Montgomery | 229/43 |
| 3,438,483 | 4/1969 | Miller et al. | 229/43 X |
| 3,580,478 | 5/1971 | Bemiss | 229/43 |
| 3,615,707 | 10/1971 | Filz | 229/43 |
| 3,715,073 | 2/1973 | Gibbs et al. | 229/43 |
| 3,854,649 | 12/1974 | Wagner et al. | 229/3.5 MF |
| 4,026,460 | 5/1977 | May | 229/DIG. 14 |
| 4,190,191 | 2/1980 | Forbes, Jr. | 229/43 |

*Primary Examiner*—Davis T. Moorhead

*Attorney, Agent, or Firm*—Birch, Stewart, Kolasch & Birch

[57] ABSTRACT

A flat planar lid for ovenable containers is described which is uniquely shaped to permit the lid to be manually secured to a flanged ovenable container thereby effectively closing and sealing the flanged container without the need to use automatic sealing equipment. The planar lid is shaped to provide a longitudinal tab overlapping each longitudinal edge of the container, a transverse tab overlapping each transverse edge of the container, and a corner tab overlapping each corner of the container. These tabs of the lid are tucked over the container flange and adhesively bonded to the underlying surface thereof. Venting is provided to permit a mechanism for venting internal steam to the atmosphere when the container and its contents are heated. The corner tabs have a lesser outboard reach than the outboard reach of either the longitudinal or transverse tabs to provide a smooth and substantially flat adhesive bond with the underflange surface.

15 Claims, 7 Drawing Figures

LID FOR OVENABLE TRAYS AND RESULTING COMBINED CONTAINER

FIELD OF THE INVENTION

The present invention relates to flanged food containers and closure means or lids for the same and, more particularly, to flanged food containers in which prepared foods are heated for serving, and leaving adhesively bonded closure means associated therewith.

BACKGROUND OF THE INVENTION

With the wide variety of prepared foods available on today's market, there is a need in the food vending and serving art to provide containers for prepared foods which may be properly utilized for holding and shipping prepared foods to the point of sale, and thereafter utilized as an ovenable container for heating that food, in such as microwave ovens, for ultimate consumption.

Such containers are usually made in the form of deep dishes or pans having sidewalls extending upward from a bottom portion and having an out-turned peripheral or annular flange completely surrounding the upper edge of the sidewalls on such a container. These containers may vary in shape from square to round to rectangular as the case may be.

A universally acceptable type lid for this type of container would have the advantages of self-venting, ease of imprinting logos and content information, be so shaped and so proportioned as to make stacking of lidded containers facile and feasible and readily adapted for manual or automatic attachment to the container on which the lid is to be placed. However, in the prior art, there is no method of effectively closing or sealing a lid to a flanged container without the use of automatic or semi-automatic sealing equipment.

It is therefore an object of the present invention to provide a new and novel combined container and lid structure for periphally flanged food containers and the like.

Another object of the present invention is to provide a new and novel lid structure for periphally flanged food containers and the like which provides a means for manually securing the lid to the flanged food container without the need for utilization of automatic or semi-automatic sealing equipment.

Still another object of the present invention is to provide a new and novel lid structure for periphally flanged food containers and the like which is of a self-venting configuration.

These and other objects of the present invention will become more fully apparent with reference to the following specification and drawings which relate to the preferred embodiments of the present invention.

SUMMARY OF THE INVENTION

The closure lid of the present invention comprises a flat sheet of paperboard or the like having a unique shape to permit the lid to be manually secured to a flanged ovenable container without the need to use automatic sealing equipment. The planar lid is shaped to provide a longitudinal tab for overlapping each longitudinal edge of the flange of the ovenable container, a transverse tab for overlapping each transverse edge of the flange of the container, and a corner tab for overlapping each corner of the flange of the container.

Each corner tab of the lid is folded over the corner edge of the container flange and then engaged with the underflange surface. Each of the longitudinal and transverse tabs of the lid are likewise tucked under and adhesively bonded to the said underflange surface.

This structure also provides a means through which the food in the container will vent to the atmosphere through the corner tabs of the lid, which corner tabs have been folded over each of the corner edges of the ovenable flanged container. Each corner tab has a portion of the adhesive removed in a basically rectilinear pattern such that the steam or expanding air from the internal portion of the flanged container may escape through a port defined between the flange and the corner tab through a gap defined in the adhesive material by the patterned application thereof.

The lid may be of a laminated paperboard and polyethylene or polyester material such that heat sealing of the lid may be effected onto the underflange surface of the container.

Because of the flat planar shape of the lid, the lid may be readily printed upon with logos, content information, etc.

The lid configuration is preferably a conformal approximation of that of the underlying container so that an ovenable combination package is provided which does not require substantially more room than the container per se. These containers with the lids of the present invention thereon are readily usable for heating prepared foods packaged therein in microwave ovens and the like. After heating, the lid is readily removable and the underlying container can be used as an individual serving dish as well.

In circumstances in which containers of food are to be heated in an uncovered condition, the closure lid of the present invention can be made without the above-described vent means.

Also, instead of polyethylene, polyester or the like as a heat sealable laminate on either or both of the underlying container flange and overlying lid structure, various heat sealable adhesives or pressure sensitive adhesives of a non-toxic nature may be placed upon the lid and/or flange to thereby provide manual sealing of the given container and the lid combination if desired.

DETAILED DESCRIPTION OF THE DRAWINGS

Figure 1:
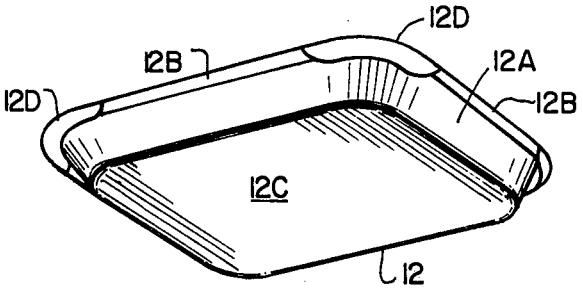
FIG. 1 is a perspective view of a container and lid combination of the present invention.
Figure 2:
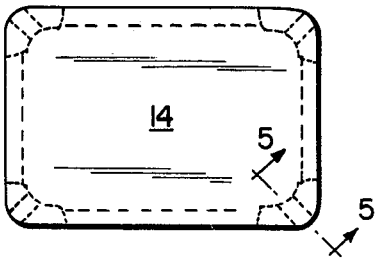
FIG. 2 is a top plan view of the container and lid combination of FIG. 1.
Figure 3:
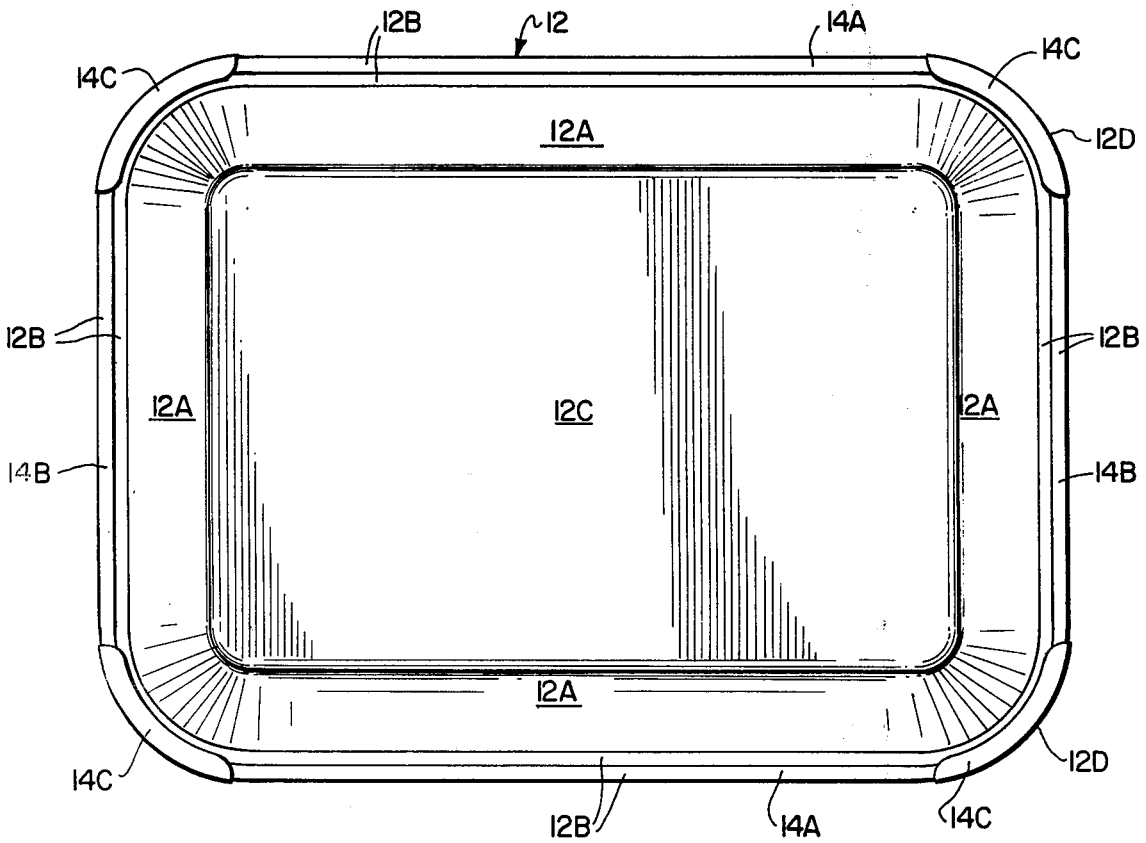
FIG. 3 is a bottom plan view of the container and lid combination of FIG. 1.
Figure 4:
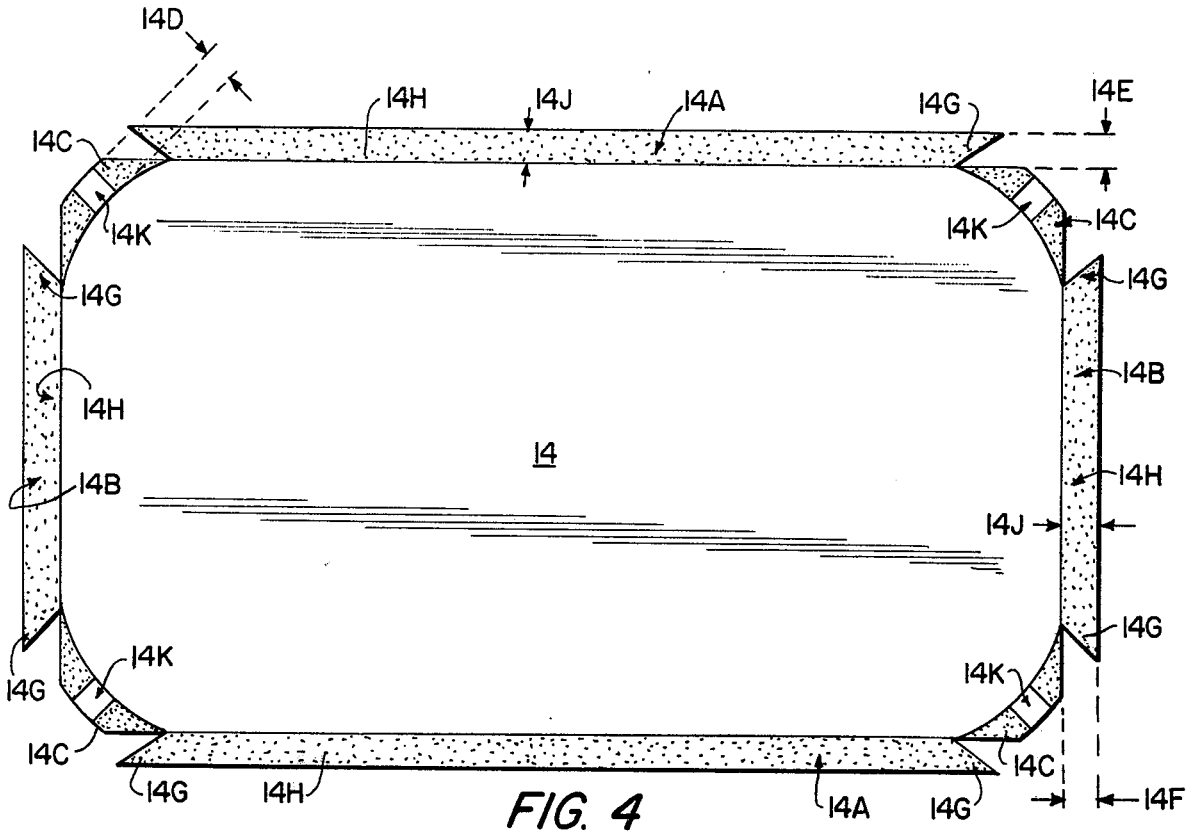
FIG. 4 is a bottom plan view of a lid of the present invention prior to combining with a container.

Referring to FIGS. 1, 3 and 4, a lidded container combination structure of the present invention is illustrated as including a substantially rectangular container 12 having upturned sidewalls 12A and out-turned flange portions 12B surrounding the upper ends of the sidewalls and extending outboard thereof substantially parallel with a bottom portion 12C, the latter extending across the lowermost edges of the sidewalls 12A.

In the particular container illustrated, rounded corner portions 12D are provided in both the flanges 12B and the sidewalls 12A such that the container 12 is substantially a rectangular container with rounded corners.

Referring to FIG. 4, a flat planar lid 14 is illustrated as having a substantially similar shape as an underlying container 12. The flat planar lid 14 has a pair of longitudinal tabs 14A, a pair of transverse tabs 14B, and a corner tab 14C for each corner of the flat planar lid. The corner tabs 14C have a particular outboard reach designated by 14D in FIG. 4. The outboard reach 14D of each corner tab is less than the outboard reach 14E of the longitudinal tab 14A. The outboard reach 14D of each corner tab is also less than the outboard reach 14F of each transverse tab 14B.

Each of the longitudinal and transverse tabs 14A and 14B have pairs of ears 14G extending longitudinally from the ends thereof.

In addition, on the underlying surface of all the tabs 14A, 14B, and 14C, are placed bands of adhesive 14H. The band of adhesive has a predetermined width 14J which is at least substantially as great as the width of the various corner, longitudinal and transverse tabs as required. This ensures that there will be an adequate quantity of adhesive overlying the underflange surface of the container 12.

The flat planar lid 14 also provides a means for venting steam, which is generated inside the ovenable container 12, to the atmosphere. On the underlying surface of each corner tab 14C, a path or gap 14K is defined through the adhesive 14H such that there is no adhesive 14H therein.

Referring to FIG. 3, each longitudinal tab 14A and each transverse tab 14B are folded over the flanged portions 12B of the underlying container 12. Once the longitudinal tabs 14A and the transverse tabs 14B are folded over the flanged portions 12B of the underlying container 12, each corner tab 14C is then folded over its particular corner as shown in FIG. 3.

Since the bands of adhesive 14H completely surround the outer periphery of the underlying portion of the flat planar lid 14, the adhesive on the undersides of the longitudinal tabs 14A and the transverse tabs 14B will cause each of these tabs to firmly and securely adhere to the underflange surface of the flanged portion 12B of the underlying container 12. The ears 14G associated with each longitudinal and transverse tab will also be firmly secured to the said underflange surface of the flange 12B. The adhesive which also appears on the underside of each corner tab 14C will then cause each said corner tab 14C to firmly adhere to the ears 14G of the longitudinal and transverse tabs 14A and 14B when folded over its corresponding corner portion 12D of the underlying container 12. The flat planar lid 14 may be securely mounted in this manner to its underlying container 12 by manual means without the need to resort to automatic sealing equipment.

Figure 5:
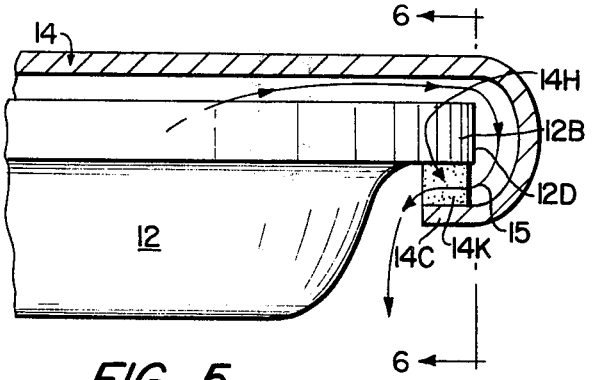
FIG. 5 is an enlarged cross section of a corner vent configuration of the invention taken along line 5—5 of FIG. 2.
Figure 6:
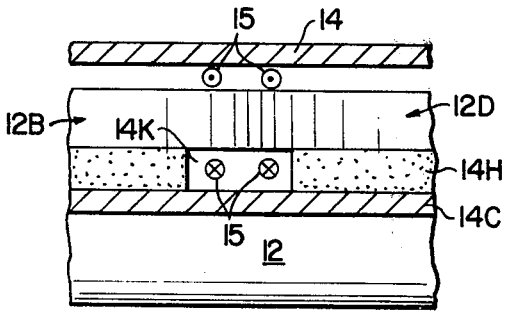
FIG. 6 is a cross-section taken along line 6—6 of FIG. 5.

Referring to FIGS. 5 and 6, the gap 14K in adhesive 14H is shown as forming a vent path between a corner tab 14C and flange 12B as illustrated by the arrow 15. Since the gap 14K is devoid of adhesive 14H, when each corner tab 14C is folded over the respective corner flange portion 12D of the flange 12B on the underlying container 12 there will be a natural venting hole represented by the said arrow 15 through which steam being generated inside the ovenable container will be allowed to escape to the atmosphere.

Figure 7:
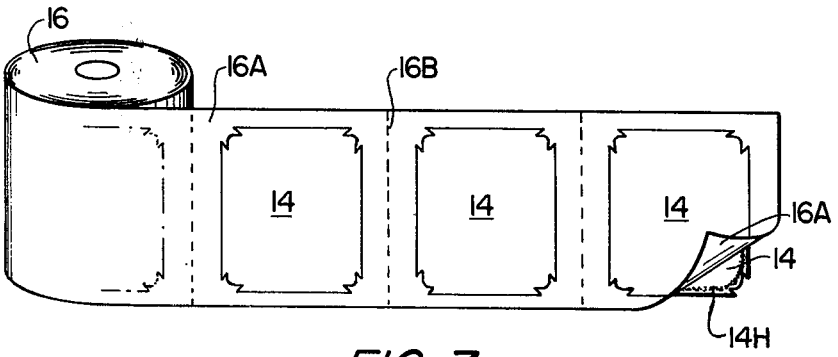
FIG. 7 illustrates the manner in which lid structures of the present invention are provided in rolls for subsequent removal and placement on respective underlying containers.

Referring to FIG. 7, there is illustrated a means by which the lids 14 of the subject invention may be stored on rolls 16 of a protective backing 16A such that the said backing may be peeled from the lids 14 and the lids subsequently manually placed over the underlying container 12 without the need to resort to automatic sealing equipment. The protective backing 16A is necessary to protect the bands of adhesive 14H, maintain the lids 14 sanitary and further facilitate the ease of placement of the lids 14 over underlying containers 12. The backing 16A may be perforated along lines 16B for separating lids 14 with the backing 16A in place.

It can be seen from FIG. 1 that the lid is first placed over the underlying container 12. Each of the longitudinal tabs 14A is then folded over the respective underlying flanged portions 12B of the underlying container and securely adhered to the underflange surface. Each of the transverse tabs 14B is then folded over the underlying flanged portion 12B of the underlying container 12 and securely adhered to the underflange surface. Following this each of the corner tabs 14C is then folded over and secured to the underflange surface over the ears 14G of each of the longitudinal tabs 14A and the transverse tabs 14B such that a flat corner gusset structure is effected. Each of the ears 14G are then firmly secured under each of the corner tabs 14C. The existence of the gaps 14K in the adhesive 14H on the corner tabs 14C allows for steam to escape as previously described.

It should be understood that the Lid for Ovenable Trays and Resulting Combined Container of the present invention may be modified as would occur to one of the ordinary skill in the art without departing from the spirit and scope of the present invention.

What is claimed is:

1. a lidded container structure, comprising:

a container having a bottom web portion, upstanding sidewalls surrounding said bottom web portion extending therefrom to form an open mouth;

an outwardly extending peripheral flange on said sidewalls, substantially parallel with said bottom web portion defining said open mouth and including longitudinal, transverse and corner portions;

a lid sealed onto said container and substantially conforming to the shape of said peripheral flange when sealed thereto;

said lid comprising a body portion having a shape substantially conforming to the shape of said peripheral flange;

first and second opposed pairs of longitudinal and transverse tabs on said body portion extending along the longitudinal and transverse edges, respectively, of said peripheral flange outboard from said body portion and firmly secured to the underflange surface of said peripheral flange;

corner tab means on said body portion between adjacent ends of said longitudinal and transverse tabs securing corresponding corner portions of said lid beneath those of said peripheral flange;

said corner tab means extending outboard from said peripheral flange; and the outboard reach of each said longitudinal and transverse tabs being greater than the outboard reach of each of said corner tabs thereby enabling said corner tabs to be flatly and firmly secured to said underflange surface when said lid is sealed onto said container.

2. A lidded container in accordance with claim 1 wherein a band of adhesive is formed around said lid beneath said corner tabs, said longitudinal tabs and said transverse tabs, the width of said band of adhesive being at least substantially that of said tabs.

3. A lidded container in accordance with claim 1 wherein said lid further comprises:

venting means on each of said corner tabs providing an access opening through said corner tabs of said lid to communicate the interior of said lidded container to the atmosphere.

4. A lidded container in accordance with claim 3 wherein said access opening of said venting means comprises:

gap means extending through said adhesive band on the surface of said tabs for communicating the interior of said lidded container to the atmosphere, said gap means extending across the entire width of said band of adhesive providing said access opening from within said container to the exterior of said container.

5. A lidded container in accordance with claim 1 wherein a band of adhesive is formed around said lid beneath said corner tabs, said longitudinal tabs and said transverse tabs, the width of said band of adhesive being at least substantially that of said tabs; and wherein said lid further comprises venting means on each of said corner tabs providing an access opening through said corner tabs of said lid to communicate the interior of said lidded container to the atmosphere.

6. A lidded container in accordance with claim 5 wherein said access opening of said venting means comprises:

gap means extending through said adhesive band on the surface of said tabs for communicating the interior of said lidded container to the atmosphere, said gap means providing said access opening from within said container to the exterior of said container.

7. A lidded container structure including an underlying container and a lid sealed thereto;

said container comprising a bottom web portion, upstanding sidewalls surrounding said bottom web portion and extending therefrom to form an open mouth, and an outboard peripheral flange surrounding said open mouth and providing an underflange surface; and, said lid comprising:

a central body portion of substantially conformal configuration with said open mouth;

peripheral tab means extending outboard of said central body portion and folded over said peripheral flange into juxtaposition with said underflange surface;

said tab means including gusset means providing a substantially flat, uniform fit of said tab means against said underflange surface; and sealing means on said tab means for sealing said tab means to said underflange surface.

8. The lidded container structure of claim 7 wherein said tab means includes vent means for communicating the interior of said container to the atmosphere.

9. The lidded container structure of claims 7 or 8 wherein said sealing means comprises a patterned adhesive layer on the undersurface of said tab means for adhesive sealing engagement with said underflange surface.

10. The lidded container structure of claims 7 or 8 wherein said sealing means comprises a patterned adhesive layer on the undersurface of said tab means for adhesive sealing engagement with said underflange surface; and wherein said vent means comprises gap means defined through said patterned adhesive layer to preclude a portion of said tab means commensurate with said gap means from sealing with said underflange surface.

11. A lid structure for closing and sealing an open mouth of an underlying container, the latter having an outboard peripheral flange surrounding said open mouth and providing an underflange surface, said lid comprising:

a central body portion of substantially conformal configuration to a said open mouth of a said container;

peripheral tab means extending outboard of said central body portion for folding over a said peripheral container flange into juxtaposition with the said underflange surface;

said tab means including gusset means for providing a substantially flat, uniform fit of said tab means against said underflange surface; and sealing means on said tab means for sealing said tab means to said underflange surface.

12. The lid structure of claim 11, wherein said tab means includes vent means for communicating the interior of a said container to atmosphere.

13. The lid structure of claims 11 or 12 wherein said sealing means comprises a patterned adhesive layer on the undersurface of said tab means for adhesive sealing engagement with said underflange surface.

14. The lid structure of claims 11 or 12 in combination with a removable protective backing means removably secured to said lid structure by said sealing means for protecting said sealing means and maintaining at least one side of said lid in a sanitary condition.

15. The lid structure of claims 11 or 12 in combination with a removable protective backing means removably secured to said lid structure by said sealing means for protecting said sealing means and maintaining at least one side of said lid in a sanitary condition; and wherein said sealing means comprises a patterned adhesive layer on the undersurface of said tab means for adhesive sealing engagement with said underflange surface.

* * * * *